US005907930A

United States Patent [19]

Ricco, Sr.

[11] Patent Number: 5,907,930

[45] Date of Patent: Jun. 1, 1999

[54] SHOOTING RANGE

[76] Inventor: John A. Ricco, Sr., P.O. Box 353, Pineville, Pa. 18946

[21] Appl. No.: 08/978,747

[22] Filed: Nov. 26, 1997

[51] Int. Cl.[6] ..... F41J 1/14

[52] U.S. Cl. ..... 52/79.1; 52/144; 52/269; 52/408; 52/481.1; 273/404; 273/410

[58] Field of Search ..... 52/79.1, 144, 145, 52/793.1, 481.1, 408, 267–269; 273/404, 407, 408, 410

[56] References Cited

U.S. PATENT DOCUMENTS

| | | | |
|---|---|---|---|
| 2,420,304 | 5/1947 | Diem . | |
| 3,305,993 | 2/1967 | Nelsson | 52/145 X |
| 3,404,886 | 10/1968 | Dundr . | |
| 3,447,806 | 6/1969 | Pfaff et al. . | |
| 3,602,511 | 8/1971 | Gehmann . | |
| 3,611,653 | 10/1971 | Zinn | 52/481.1 X |
| 3,737,165 | 6/1973 | Pencyla . | |
| 4,042,061 | 8/1977 | Murakami . | |
| 4,164,901 | 8/1979 | Everett . | |
| 4,247,115 | 1/1981 | Nikoden | 273/317 |
| 4,317,572 | 3/1982 | Iseli . | |
| 4,509,301 | 4/1985 | Head . | |
| 4,566,237 | 1/1986 | Turner . | |
| 4,567,100 | 1/1986 | Picket et al. | 428/339 |
| 4,598,631 | 7/1986 | Everett . | |
| 4,683,688 | 8/1987 | Wojcinski . | |
| 4,702,046 | 10/1987 | Haugen et al. | 52/144 |
| 4,728,109 | 3/1988 | Simonetti . | |
| 4,786,059 | 11/1988 | Barini . | |
| 4,787,289 | 11/1988 | Duer . | |
| 4,822,657 | 4/1989 | Simpson | 428/69 |
| 4,856,791 | 8/1989 | McQuade . | |
| 4,919,437 | 4/1990 | Salabe et al. . | |
| 5,040,802 | 8/1991 | Wojcinski et al. . | |
| 5,088,741 | 2/1992 | Simonetti . | |
| 5,121,671 | 6/1992 | Coburn . | |
| 5,255,924 | 10/1993 | Copius . | |
| 5,366,105 | 11/1994 | Kerman et al. | 89/36.02 X |
| 5,400,692 | 3/1995 | Bateman . | |
| 5,456,155 | 10/1995 | Myrtoglou . | |
| 5,592,796 | 1/1997 | Landers | 52/481.1 X |

OTHER PUBLICATIONS

National Rifle Association Range Department, *The Range Manual Indoor Range Design Criteria*, 1988.

*Primary Examiner*—Robert Canfield
*Attorney, Agent, or Firm*—Seidel, Gonda, Lavorgna & Monaco, PC

[57] ABSTRACT

A shooting range having shooting booths with protective side walls constructed of an armour plate, soft metal framing studs running vertically along the armour plate, porous insulation material disposed between the framing studs and against the armour plate, and a sheet of sound-proofing tile attached to the framing studs and covering the porous material. The booths' ceiling is constructed of an armour plate meeting the upper edge of the armour plates of the side walls and a layer of sound-proofing tile extending between the side walls and located below and apart from the ceiling armor plate to define a space to accommodate the return end of a target transport system. The target carrier includes a two-prong target hook wherein the shaft and prong arms are formed detachable segments to facilitate replacement of a segment damaged by a bullet. The bullet trap includes a sand backstop having a reflected angle support structure to support a mound of sand.

9 Claims, 6 Drawing Sheets

SHOOTING RANGE

FIELD OF THE INVENTION

This invention relates to the general field of firearm shooting ranges, and to the particular field of safety features for shooting ranges.

BACKGROUND OF THE INVENTION

There are a wide variety of firing ranges and range equipment, often depending upon whether the range is indoor and outdoor, and on the type of firearm or target the range is designed for, i.e. small bore pistol, action pistol, small bore rifle, high power rifle, airgun, shotgun, black powder, silhouette target, moving target, and et cetera. Suggested design criteria for the various types of ranges may be found in publications such as *The Range Manual* published by the National Rifle Association of America.

The present invention is directed primarily toward an indoor range with certain safety features to accommodate the use of a wide variety of firearms, extending from airguns and handguns through high power rifles. Objects of the invention include providing a safer design of shooting booth with improved bullet stop and retention material in its walls, a target transport system which carries the target well within the protective confine of the booth, high level of sound proofing, a robust bullet trap adequate for low and high velocity bullets and for soft lead to hard jacketed bullets, good smoke removal and ventilation, an efficient lighting pattern, and an improved target carrier. Other advantages of the invention will become apparent from the following drawings and detailed description of a preferred embodiment.

SUMMARY OF THE INVENTION

A preferred embodiment of the invention is found in a firing range having shooting booths with protective side walls constructed of armour plate, soft metal framing studs running vertically along the plate with insulating material disposed between the framing studs and against the plate, and a sheet of sound-proofing tile attached to the framing studs and covering the insulating material. The ceiling of the booth is constructed of an armour plate meeting the upper edge of the armour plates of the side walls, and a layer of sound-proofing tile between the side walls below and apart from the ceiling armour defines a space to accommodate the return end of a target transport system. The ceiling tile has a slot to allow a target carrier to extend through the slot and carry the target well within the protective confine of the booth. The ceiling tile is angled upward at the rear of the booth to facilitate lighting and ventilation.

Lighting in the booths is provided by a row of fluorescent light tubes and diffusion cover located in the ceiling of the range facility directly behind the booths, and provides an even, bright, non-glare illumination from above and behind the shooters. Ventilation air is blown through the booths from above and behind the shooters, and air is removed from the facility by take out ducts in front of the booths to direct and remove smoke from the booths without allowing it to spread into the range facility.

The bullet trap is a floor to ceiling damp sand backstop supported by a reflected angle support structure, and is enclosed within a cage of armour plating. The target carrier is a two- prong hook hanger with easily replaceable sections in the event that a bullet impact bends or severs a section.

BRIEF DESCRIPTION OF THE DRAWINGS

The drawings show a form of the invention which is presently preferred; however, the invention is not limited to the precise arrangement shown in the drawings.

DETAILED DESCRIPTION OF THE INVENTION

Figure 1:
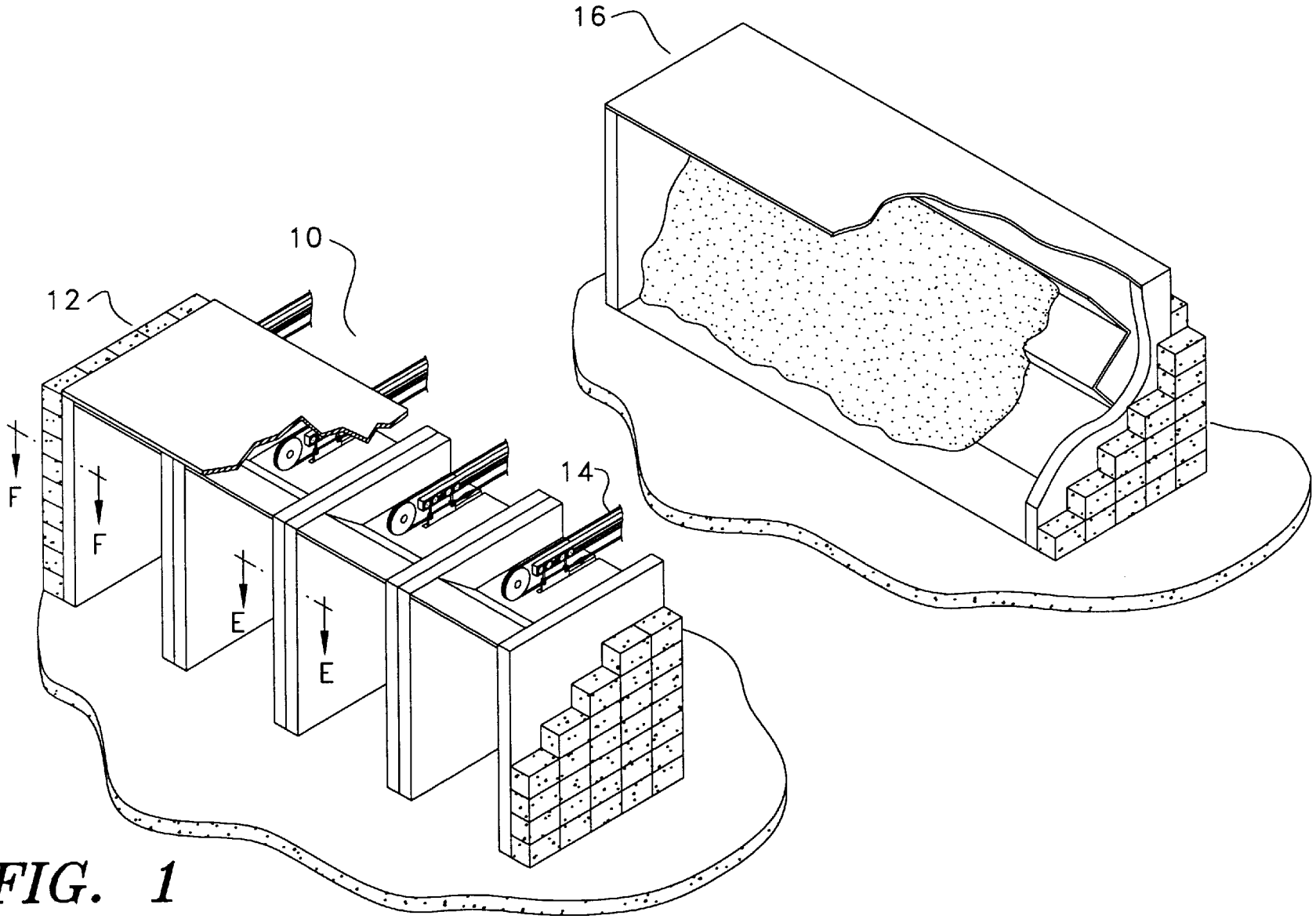
FIG. 1 is a schematic depiction of the relevant portions of a shooting range according to the invention.

FIG. 1 shows an indoor shooting range (10) having a firing area of four shooting lanes. The shooting lane are roughly defined by the four shooting booths (12) and the four target transport systems (14) which carry a target to selected distances between the shooting booths and a bullet trap (16). Although the depicted range has a single firing area, an indoor range facility can have several such areas isolated from each other by walls and interconnected by doors. An indoor facility developed according to this invention has three such firing areas separated by masonry block walls.

Figure 2:
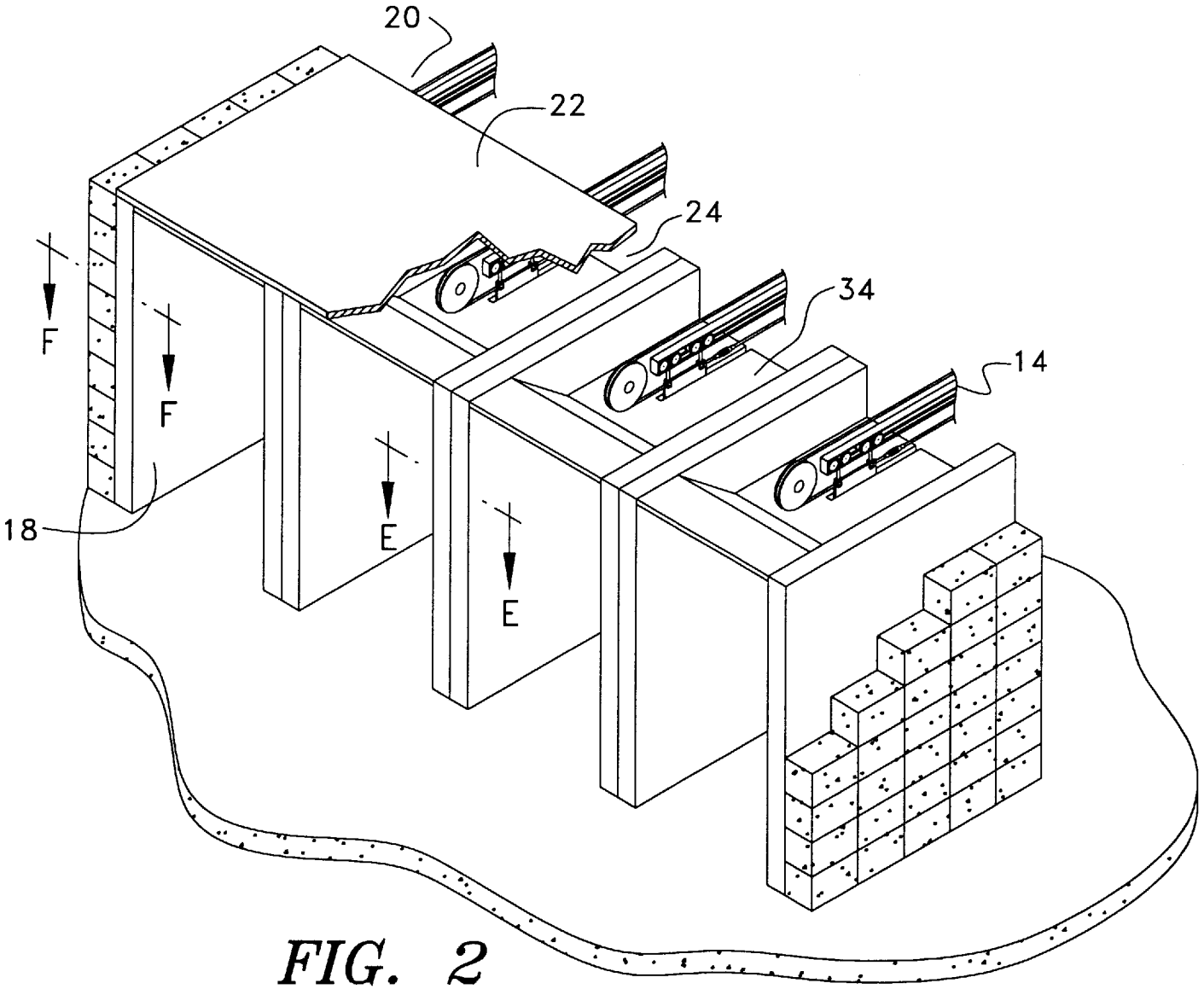
FIG. 2 is a schematic depiction of the shooting booths of the present invention with the ceiling armour shown in exploded relationship.

The shooting booths are shown in more detail in FIG. 2. Each booth comprises two side walls (18) and a ceiling (20). The ceiling is formed by an armour plate (22) and a layer of sound-proofing tile (34) which extends between the side walls and is located below and apart from the ceiling armour plate to define a space (24) to accommodate the return end of a target transport system (14). The ceiling will be described in further detail below in respect to FIG. 5.

Figure 4:
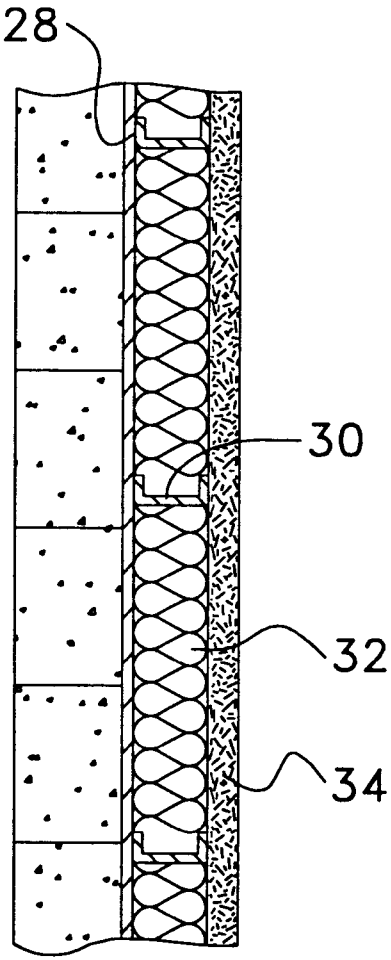
FIG. 4 is a section view of a wall of an end shooting booth taken along the lines F—F of FIG. 2.
Figure 3:
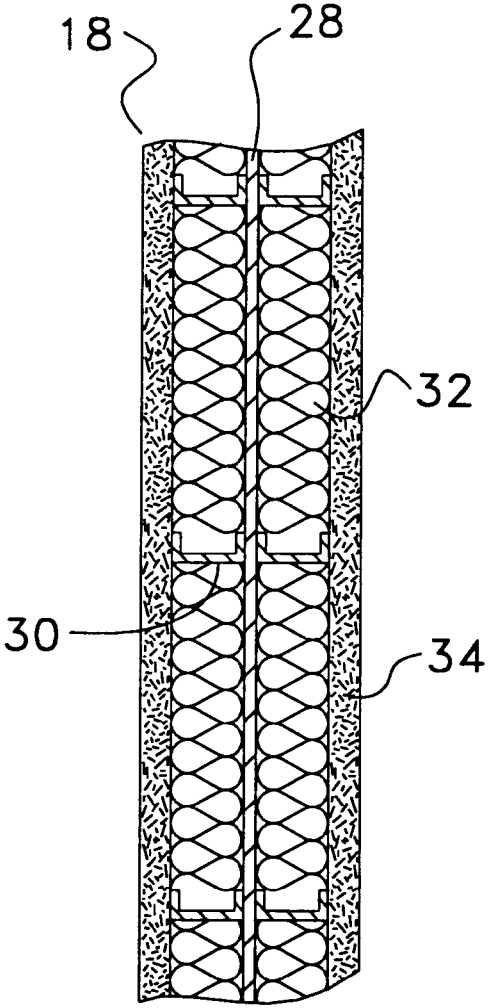
FIG. 3 is a section view of a wall of adjoining shooting booths taken along the lines E—E of FIG. 2.

The construction of the shooting booth walls (18) is best seen in the section FIGS. 3 and 4. Each booth wall is constructed of an armour plate (28), preferably 8 by 10 foot, quarter-inch thick plates of 425 abrasive armour plating. The wall plate is oriented to have its 10 foot side as wall height and the 8 foot side as wall depth. The bottom of the plate may be secured to the floor by an angle iron or other attachment. Framing studs (30) of soft metal, such as 1⅝ inch wide aluminum "C" channel studs for drywall installation, are run vertically along the armour plate and spaced apart from each other at regular intervals, such as twelve, sixteen or eighteen inches. A porous material (32) such as synthetic fiber insulation batting is disposed between the framing studs and against the armour plate. A sheet of sound-proofing tile (34) is attached to the framing studs and covers the porous insulating material. The tile is preferably a one-inch thick tile of Tectum® sound proofing material.

The above wall construction provides improved bullet retention and sound proofing over walls constructed of bare armour or armour covered by wood. A bullet inadvertently discharged into the wall will be stopped by the abrasive armour plate, and deflected in whole or in fragments along the plate. The deflected bullet or fragments will be slowed and retained by the batting and soft metal framing studs.

Figure 5:
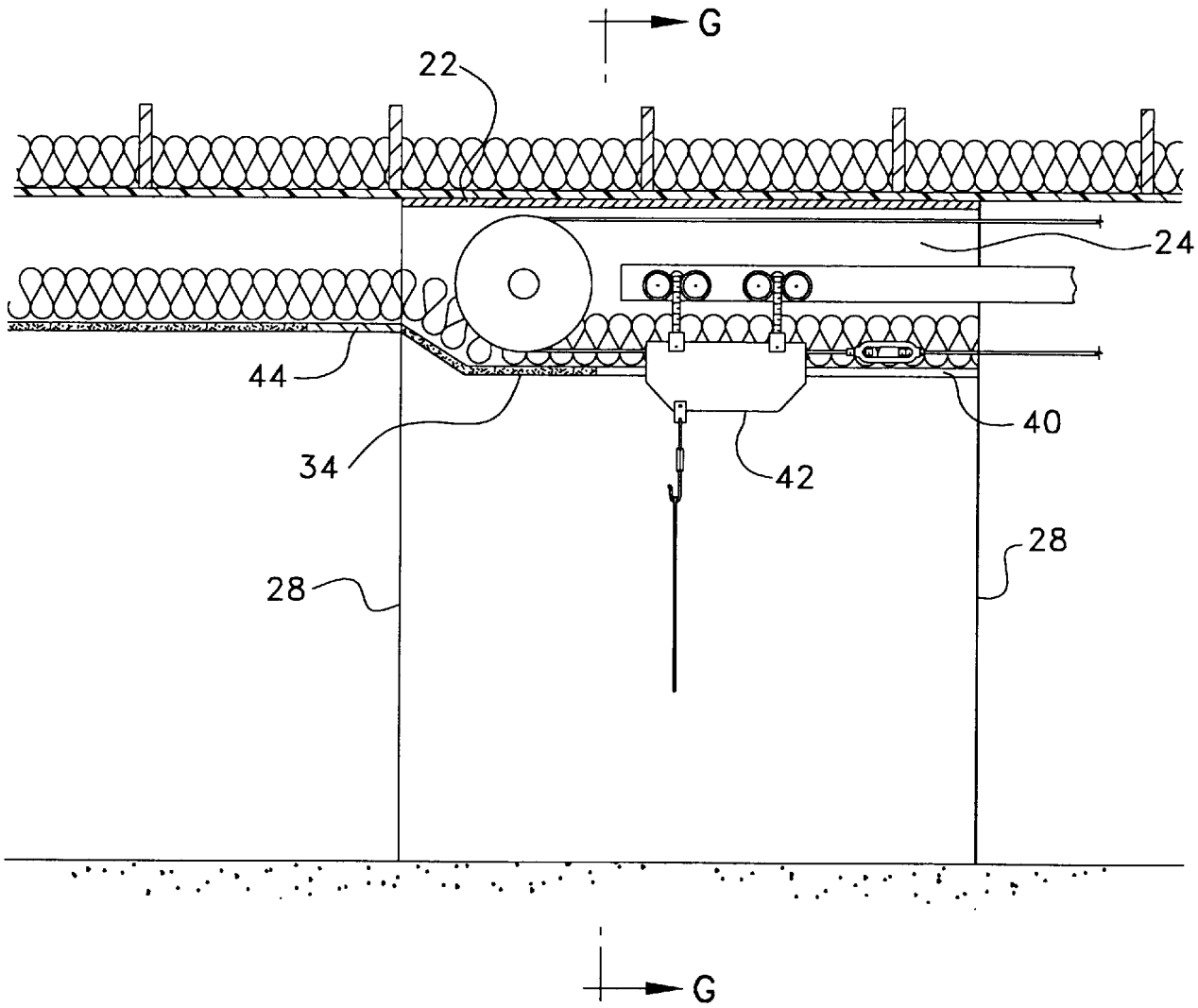
FIG. 5 is a schematic depicted a side section of a shooting booth according to the invention.

The booth's ceiling is shown in greater detail in FIG. 5. The ceiling is constructed of an armour plate (22), again preferably quarter-inch thick 425 abrasive armour plating, which meets the upper edge of the armour plates (28) of the side walls. The joint between the wall and ceiling plates is welded to provide structural support. A layer of sound-proofing tile (34), again preferably one-inch Tectum®, extends between the side walls but is located below the ceiling armour plate a sufficient distance to define an open space (24) to accommodate the return end of a target transport system. The ceiling tile has a slot (40) at its front end to allow a target carrier (42) to extend through the slot and enable the target to be carried well within the protective confine of the booth.

The ceiling layer of sound-proof tile (34) is angled upward at the rear of the booth to facilitate lighting and ventilation. Lighting in the booths is provided by a row of light fixtures (44), preferably fluorescent light tubes with a diffusion cover, located in the ceiling of the range facility directly behind the booths, to provide an even distribution of bright, non-glare light from above and behind the shooters.

Ventilation air is introduced to the range from behind the shooting booths and is blown through the booths from above and behind the shooters. The air is removed from the facility by take- out ducts located in the shooting lanes in front of the booths. This ventilation path directs and remove smokes from the booths without allowing it to spread through the range facility.

Figure 6:
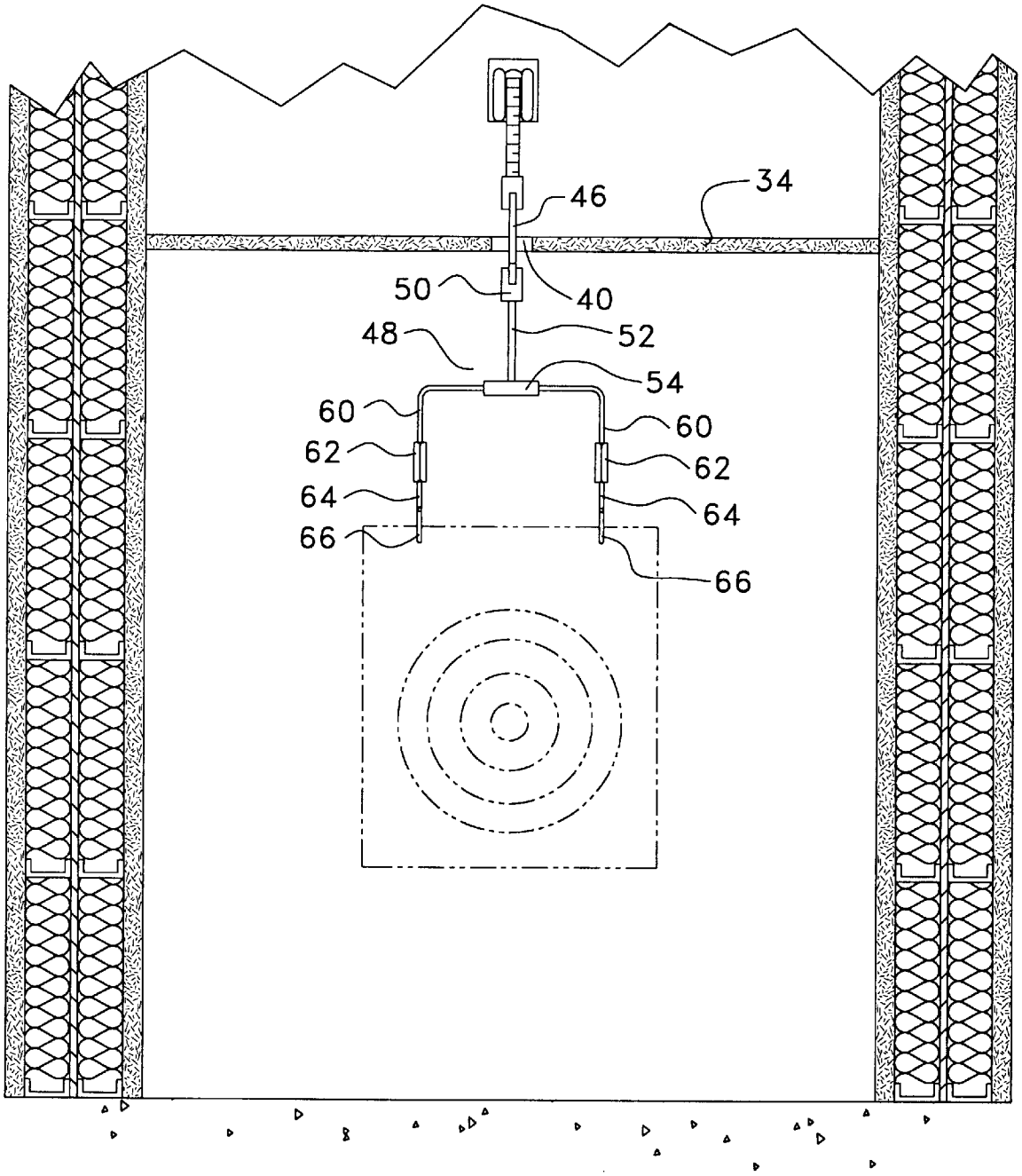
FIG. 6 is a front view of the target carrier taken along the lines G—G of FIG. 5.

As shown in FIG. 6, the target carrier (42) includes a carrier plate (46) which is attached at its top end to the target transport system and is attached at its bottom end to a two-prong target hook (48). The carrier plate (46) is the portion of the target carrier which extends through the slot (40) in the ceiling tile.

The two-prong target hook (48) is specially assembled in easily replaceable segments because the shaft and prong arms can be bent or severed by a bullet. A hollow metal cylinder (50) is attached to the bottom center of the carrier plate and serves as a socket to receive a hollow connecting shaft (52) between the carrier plate and the prong arms. The opposite (lower) end of the connecting shaft attaches to a T-fitting (54) made from a short segment of pipe (56) with a threaded UNC nut (58) welded to its bottom. The upper arms (60) of the prongs are threaded to match the UNC nut (58) and an upper arm (60) is screwed into each side of the nut. The opposite ends of the upper arms are also threaded and a UNC nut (62) is screwed onto each end. Lower arms (64) of the prongs are threaded at the upper end to be attached to the UNC nut (62), and are formed with a hook (66) at the opposite end to hold a target. The plate-to-cylinder attachment and the attachment at both ends of the connecting shaft are by holes and cotter-pin. Thus if any segment is damaged by bullet impact, it can be disconnected and replaced with having to replace the entire prong assembly.

Figure 7:
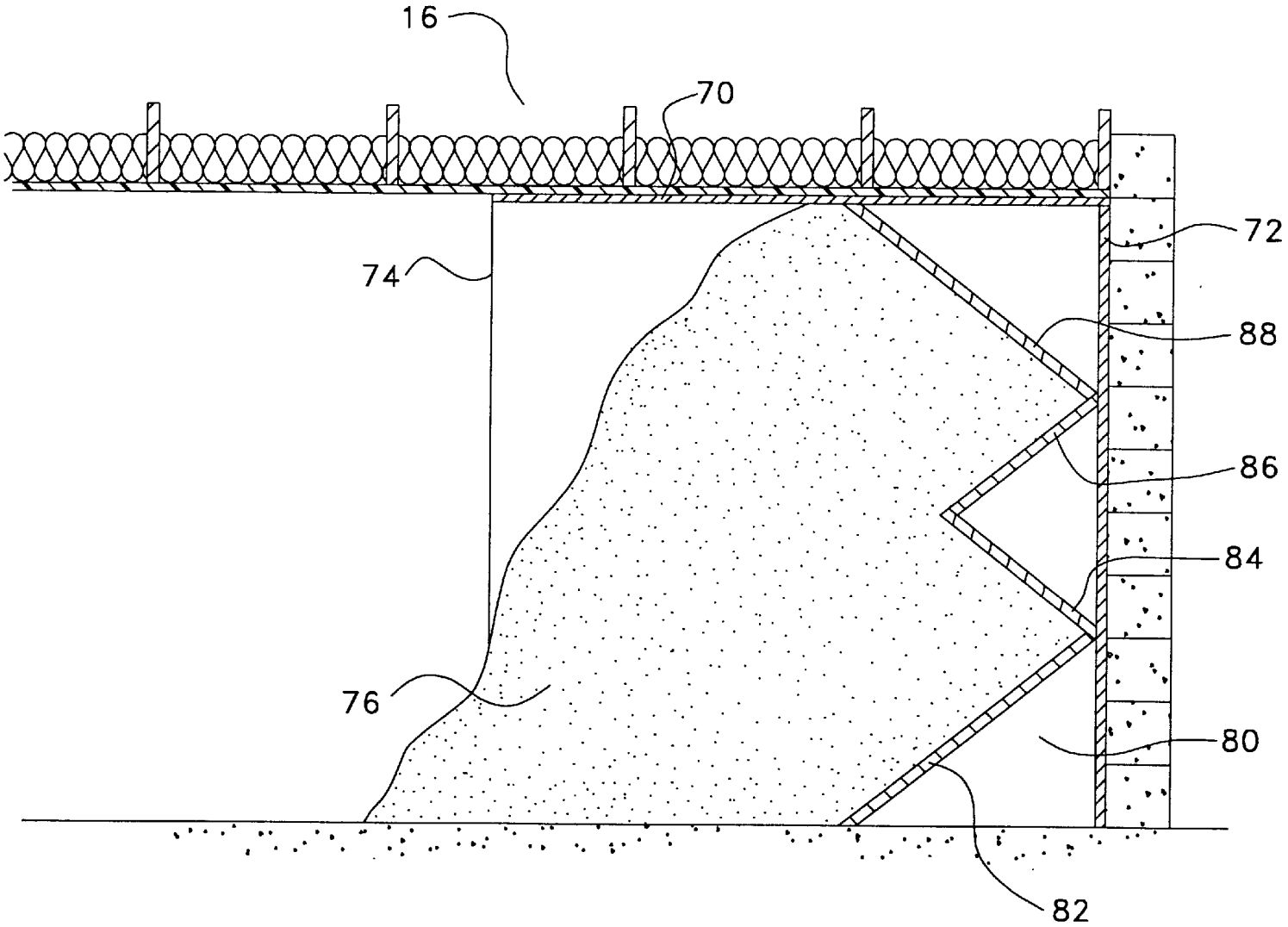
FIG. 7 is a side section view of the bullet trap.

As shown in FIG. 7, the bullet trap (16) is a floor-to-ceiling damp sand backstop to accommodate a wide variation in bullet velocity and bullet construction. The trap is enclosed within a cage of armour plating, i.e. armour ceiling plate (70) and armour plate (72, 74) on the back wall and sidewalls. To reduce the amount of sand required and still provide a sufficiently thick mound (76) of sand, a reflected angle support structure (80) is provided by steel baffle plates welded to the back wall armour plate. Preferably there are four baffle plates. The bottom baffle (82) joins the back wall about one-third height from the floor and at about a 45° angle into the back wall. The second plate (84) is welded to the lower plate (82) at a right angle and is shorter than the bottom plate such that the upper edge of this intermediate plate (84) is about midway from floor to ceiling. The upper two baffle plates are a reflection of the lower two plates, i.e. the third plate (86) is essentially the same as the bottom plate (82), and the top plate (88) essentially the same as the second plate (84). This places the joint between the third and top plates about two-thirds distance from floor to ceiling. The support structure allows the sand mound to be piled from floor to ceiling at a relatively steep angle, eliminating the need for a ricochet eye-brow catcher.

I claim:

1. A shooting range having one or more shooting booths with protective side walls, each wall constructed of:

(a) an armour plate;

(b) soft metal framing studs running vertically along the armour plate and spaced apart from each other;

(c) porous material disposed between the framing studs and against the armour plate; and (d) a sheet of sound-proofing tile attached to the framing studs and covering the porous material.

2. A range as in claim 1, further having a ceiling constructed of:

(a) an armour plate meeting the upper edge of the armour plates of the side walls;

(b) a layer of sound-proofing tile extending between the side walls and located below and apart from the ceiling armour plate to define a space to accommodate the return end of a target transport system, said layer of sound-proofing tile having a slot to allow a target carrier to extend through the sheet.

3. A range as in claim 2, wherein porous material is disposed on top of the ceiling layer of sound-proofing tile.

4. A range as in claim 2, wherein the ceiling layer of sound-proofing tile is angled upward at a rear end of the one or more booths to facilitate lighting and ventilation of the one or mores.

5. A range as in claim 1, further including a bullet trap, the trap comprising a sand backstop having a reflected angle support structure to support a mound of sand.

6. A range as in claim 5, wherein the trap is enclosed within an armour cage of armour plate sidewalls and an armour plate ceiling.

7. A range as in claim 6, wherein the sand mound extends up to the armour plate ceiling.

8. A range as in claim 2, further including a target carrier, the carrier comprising a two-prong target hook.

9. A range as in claim 8, the target carrier having a shaft and prong arms which are formed in detachable segments to facilitate replacement of a segment damaged by a bullet.

* * * * *